US009371837B2

(12) United States Patent
Tsai

(10) Patent No.: US 9,371,837 B2
(45) Date of Patent: Jun. 21, 2016

(54) AIR PUMP WITH INTERNAL AUTOMATIC CONTROLLER

(71) Applicant: DONGGUAN TIGER POINT, METAL & PLASTIC PRODUCTS CO., LTD., Dongguan, Guang Dong Province (CN)

(72) Inventor: Chun-Chung Tsai, Dongguan (CN)

(73) Assignee: DONGGUAN TIGER POINT, METAL & PLASTIC PRODUCTS CO., LTD., Dongguan (CN)

( * ) Notice: Subject to any disclaimer, the term of this patent is extended or adjusted under 35 U.S.C. 154(b) by 151 days.

(21) Appl. No.: 14/269,745

(22) Filed: May 5, 2014

(65) Prior Publication Data

US 2015/0316068 A1 Nov. 5, 2015

(51) Int. Cl.

| | |
|---|---|
| ***F04D 25/16*** | (2006.01) |
| ***F04B 35/06*** | (2006.01) |
| ***F04D 27/00*** | (2006.01) |
| ***F04D 17/12*** | (2006.01) |
| ***F04D 25/06*** | (2006.01) |
| ***F04D 29/42*** | (2006.01) |
| ***F04B 35/04*** | (2006.01) |
| ***F04B 49/02*** | (2006.01) |
| ***F04D 17/16*** | (2006.01) |

(52) U.S. Cl.

CPC ..... *F04D 25/16* (2013.01); *F04B 35/04* (2013.01); *F04B 35/06* (2013.01); *F04B 49/02* (2013.01); *F04D 17/12* (2013.01); *F04D 17/16* (2013.01); *F04D 25/06* (2013.01); *F04D 27/007* (2013.01); *F04D 29/4206* (2013.01)

(58) Field of Classification Search

CPC ..... F04D 25/06; F04D 25/08; F04D 27/008; F04D 15/02; F04D 25/16; F04D 17/16; F04D 29/4206; F04D 27/007; F04D 17/12; A47C 27/082; A47C 27/083; F04B 49/002; F04B 35/04; F04B 35/06; F04B 49/02; H01H 13/568; H01H 35/245; H01H 27/00; H01H 13/562; H01H 35/2614

See application file for complete search history.

(56) References Cited

U.S. PATENT DOCUMENTS 4,558,992 A * 12/1985 Hamano ..... F04D 27/005 417/250
7,475,443 B2 * 1/2009 Wang ..... H01H 35/245 200/82 R (Continued)

OTHER PUBLICATIONS

Mallik et al., Kinematic Analysis and Synthesis of Mechanisms, 1994, CRC Press, Inc. p. 121.*

*Primary Examiner* — Bryan Lettman
*Assistant Examiner* — Thomas Cash
(74) *Attorney, Agent, or Firm* — Birch, Stewart, Kolasch & Birch, LLP

(57) ABSTRACT

An air pump with internal automatic controller has a housing, and a low-pressure blower, a high-pressure blower, a first auto-stop controller and a second auto-stop controller mounted in the housing. The first auto-stop controller has a first casing, a first air pressure sensing film, a pushing element, a swing rod, a connecting rod, a rotation restricting element, a first micro switch, a rotational pressing rod, and a first turning button. With the low-pressure blower inflating an inflatable article with low pressure air, and with the first auto-stop controller stably and reliably controlling the low-pressure blower, the low-pressure blower stops working automatically. The first auto-stop controller has simplified structure and inflates the inflatable article without manual work, which is a great convenience to users.

8 Claims, 20 Drawing Sheets

(56) References Cited

U.S. PATENT DOCUMENTS

2007/0256747 A1* 11/2007 Morris ..... F16K 31/047
137/625.65
2010/0247355 A1* 9/2010 Pan ..... F04D 29/602
417/423.14
2011/0219895 A1* 9/2011 Sano ..... B60Q 1/1476
74/412 R
2012/0093662 A1* 4/2012 Tsai ..... A47C 27/082
417/44.2

* cited by examiner

AIR PUMP WITH INTERNAL AUTOMATIC CONTROLLER

BACKGROUND OF THE INVENTION

1. Field of the Invention

The present invention relates to an air pump, especially to an air pump with internal automatic controller.

2. Description of the Prior Art(s)

Air pumps are critical to all kinds of inflatable articles, such as airbeds, inflatable bouncers, inflatable sofas, inflatable toys, and the like. The air pump is mounted on an inner surface of the inflatable article, inflates the inflatable article and holds air inside the inflatable article at a constant pressure for use, and deflates the inflatable article for storage. Currently, some conventional air pumps can inflate and deflate the inflatable articles, and hold the air inside the inflatable articles at a constant pressure. Meanwhile, other conventional air pumps further have auto-stop controllers that stop the air pumps automatically. The auto-stop controller is mounted in a housing of the conventional air pump, and has a sensing film, a micro switch, a driving rod, a button, and a compression spring. The button is operated in a single stage, which means that when the button is pressed, the driving rod is driven to move upwardly to push the sensing film. Accordingly, the sensing film deforms upward to switch on the micro switch. When the button is released, the compression spring pushes the driving rod to move downwardly. Accordingly, the sensing film deforms downward to switch off the micro switch. The micro switch controls an operation of the conventional air pump.

The auto-stop controller allows the conventional air pump to stop working automatically, which is a great convenience to users; however, performance of the conventional air pump is still inadequate to achieve a best usage effect and a best working performance. The shortcomings of the conventional air pump are described as follows. The structure that allows the conventional air pump to stop automatically is complicated and has low stability and reliability. Moreover, the conventional air pump does not supply the air to the inflatable article automatically. Thus, when the inflatable article is deflated, the micro switch should be manually switched on in order to supply the air to the inflatable article. Furthermore, since the conventional air pump is only operated in a single stage and can only inflate the inflatable article to a specific hardness, the hardness of the inflatable article cannot be adjusted according to the user's need. Thus, the conventional air pump is inconvenient for use and operation.

To overcome the shortcomings, the present invention provides an air pump with internal automatic controller to mitigate or obviate the aforementioned problems.

SUMMARY OF THE INVENTION

The main objective of the present invention is to provide an air pump with internal automatic controller. The air pump has a housing, and a low-pressure blower, a high-pressure blower, a first auto-stop controller and a second auto-stop controller mounted in the housing. The first auto-stop controller has a first casing, a first air pressure sensing film, a pushing element, a swing rod, a connecting rod, a rotation restricting element, a first micro switch, a rotational pressing rod, and a first turning button. The first air pressure sensing film is securely mounted in the first casing and divides an interior of the first casing into a first chamber and a second chamber.

With the low-pressure blower inflating an inflatable article with low pressure air, and with the pushing element, the swing rod, the connecting rod, the rotation restricting element, the rotational pressing rod, the first turning button, the first air pressure sensing film, and the first micro switch stably and reliably controlling the low-pressure blower, the low-pressure blower stops working automatically. The first auto-stop controller has simplified structure and inflates the inflatable article without manual work, which is a great convenience to users.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
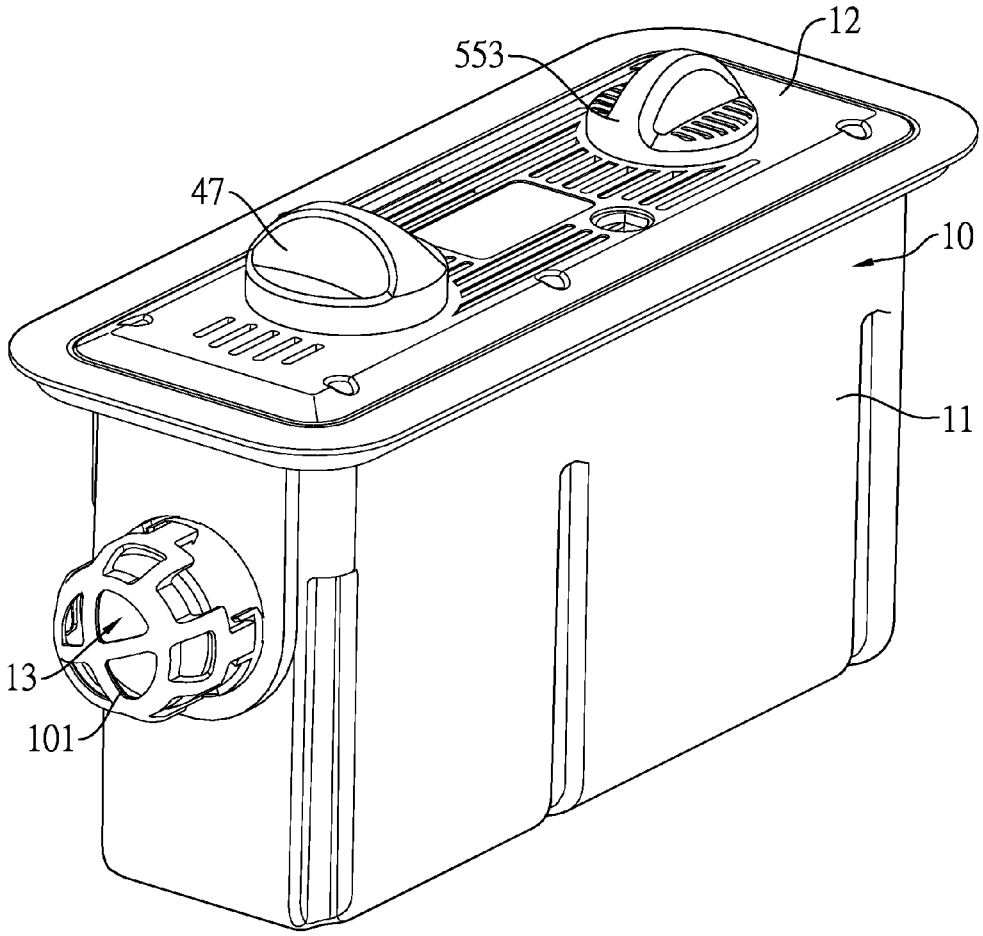
FIG. 1 is a front perspective view of a first embodiment of an air pump with internal automatic controller in accordance with the present invention.

With reference to FIGS. 1 to 4, a first preferred embodiment of an air pump with internal automatic controller in accordance with the present invention comprises a housing 10, and a low-pressure blower 20, a high-pressure blower 30, a first auto-stop controller 40, and a second auto-stop controller 50 mounted in the housing 10.

The housing 10 has a base 11, a cover 12, and a mounting chamber. The cover 12 is mounted on the base 11 and has multiple slots. The mounting chamber is defined in the housing 10, is surrounded by the base 11 and the cover 12, and communicates with an exterior of the housing 10 via the slots of the cover 12. The mounting chamber is used for receiving the low-pressure blower 20, the high-pressure blower 30, the first auto-stop controller 40, and the second auto-stop controller 50.

Figure 2:
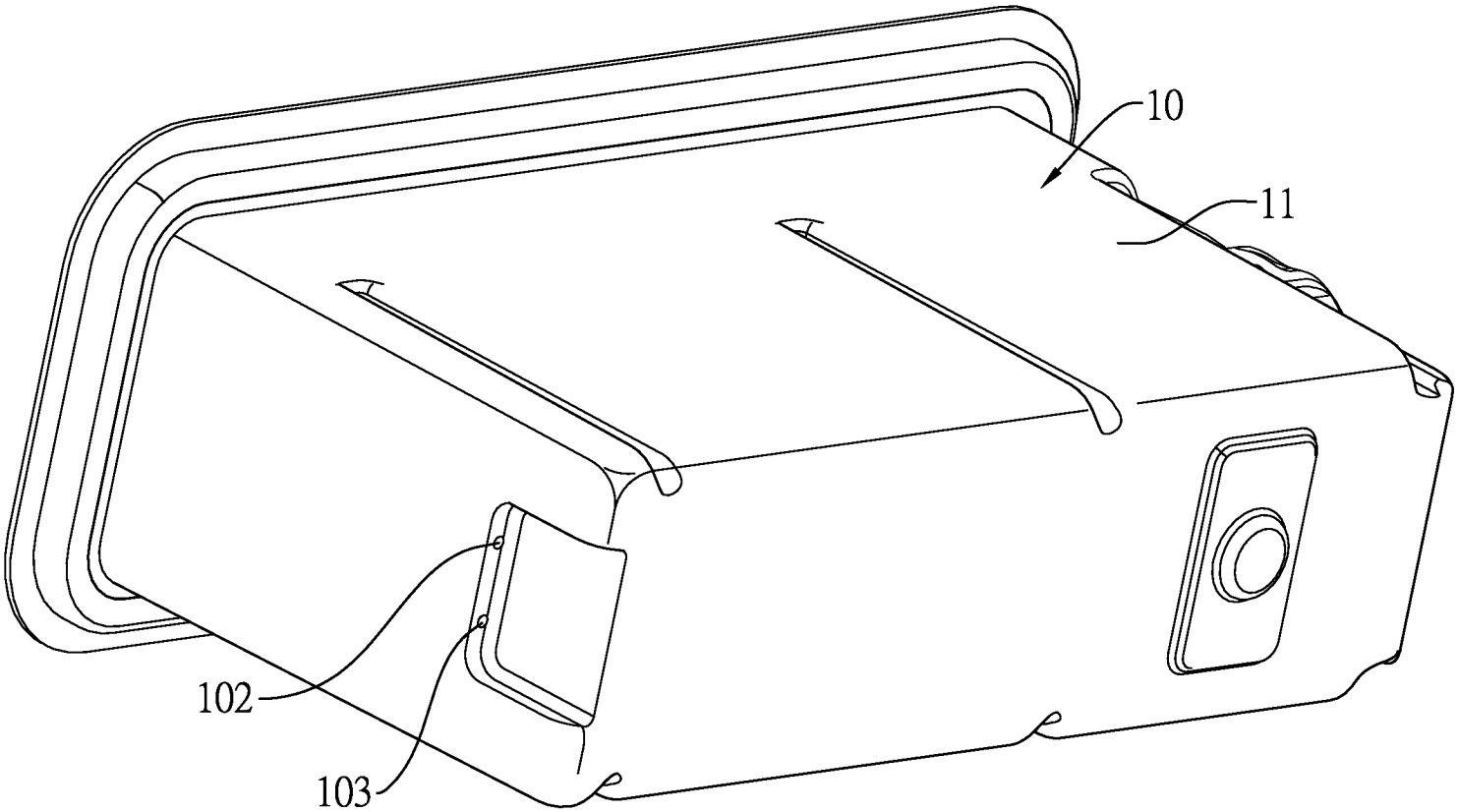
FIG. 2 is a rear lower perspective view of the air pump in FIG. 1.
Figure 3:
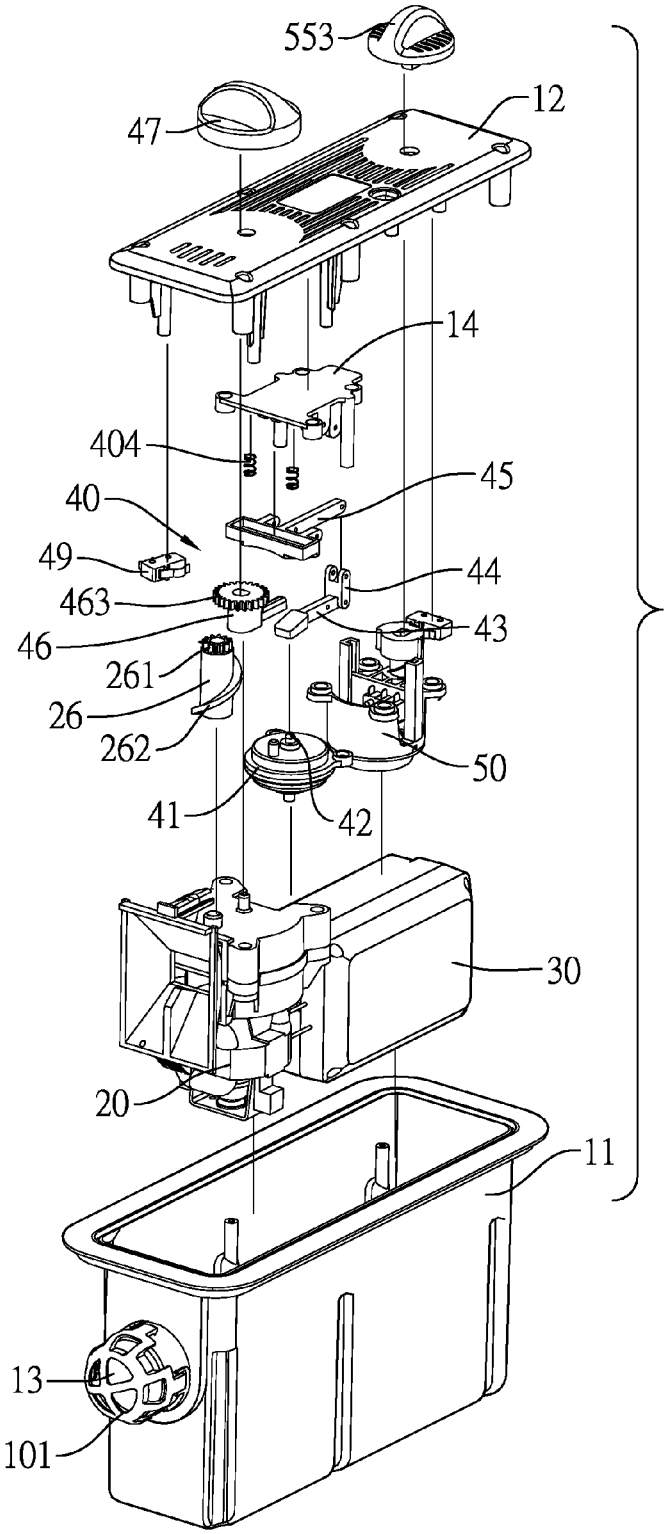
FIG. 3 is an exploded perspective view of the air pump in FIG. 1.

As shown in FIGS. 1 and 2, the housing 10 further has a first air port 101, a second air port 102, a third air port 103, a first one-way valve 13 and a second one-way valve. The first air port 101, the second air port 102, and the third air port 103 are used for communicating with an interior of an inflatable article. The first one-way valve 13 is mounted to the first air port 101. The second one-way valve is mounted to the second air port 102.

Figure 8:
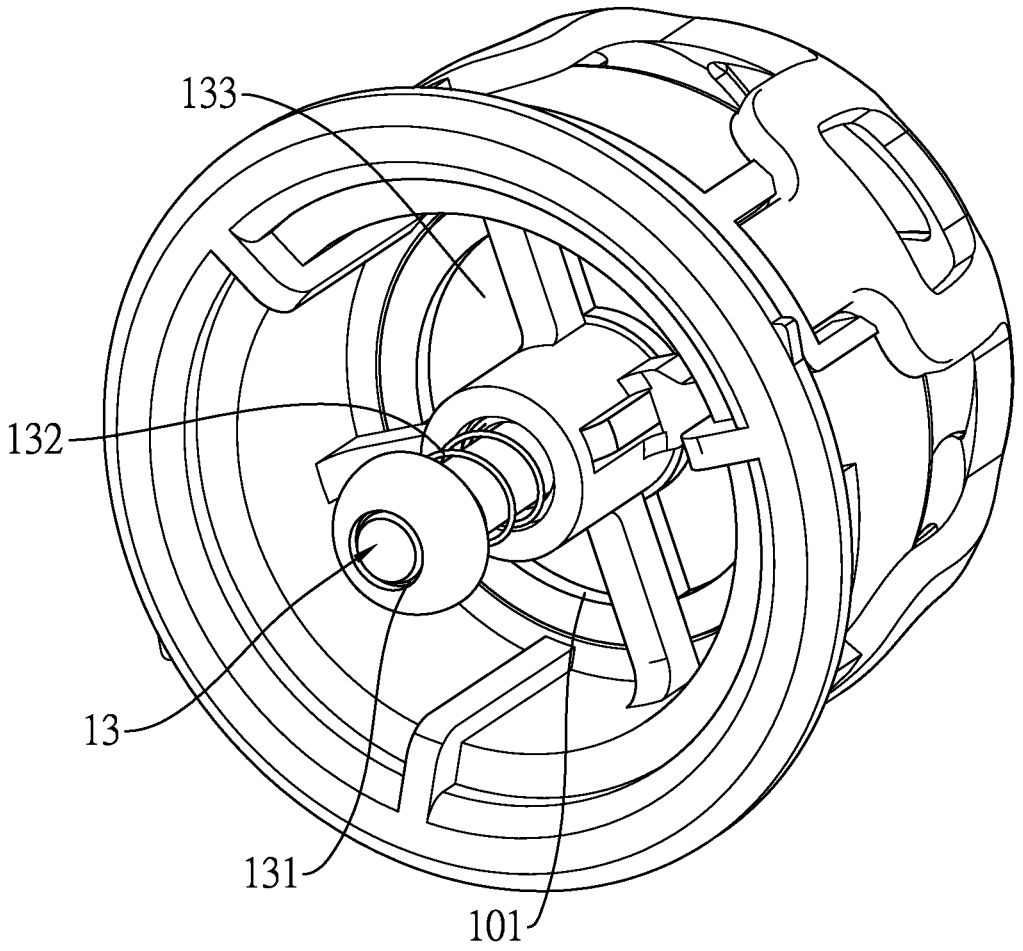
FIG. 8 is a perspective view of a first one-way valve of the air pump in FIG. 1, shown closed.
Figure 9:
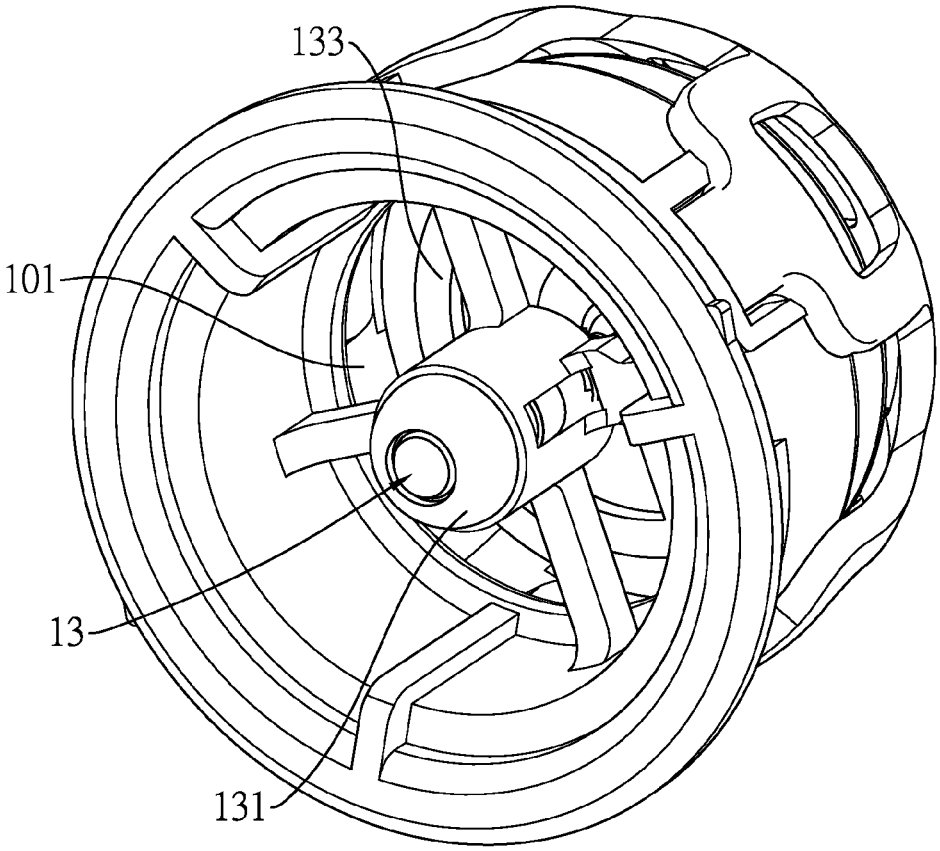
FIG. 9 is an operational perspective view of the first one-way valve in FIG. 8, shown open.

With further reference to FIGS. 8 and 9, the first one-way valve 13 has a driving rod 131, a valve blade 133, and a spring 132. The valve blade 133 is mounted on an outer end of the driving rod 131 and selectively seals the first air port 101 of the housing 10. The spring 132 is mounted around the driving rod 131 and has two opposite ends respectively abutting the housing 10 and an inner end of the driving rod 131. Thus, the spring 132 pushes the driving rod 131 to move toward the mounting chamber of the housing 10. Accordingly the valve blade 133 seals the first air port 101 of the housing 10. The second one-way valve has the same structure as the first one-way valve 13 and description about the second one-way valve is omitted.

Figure 5:
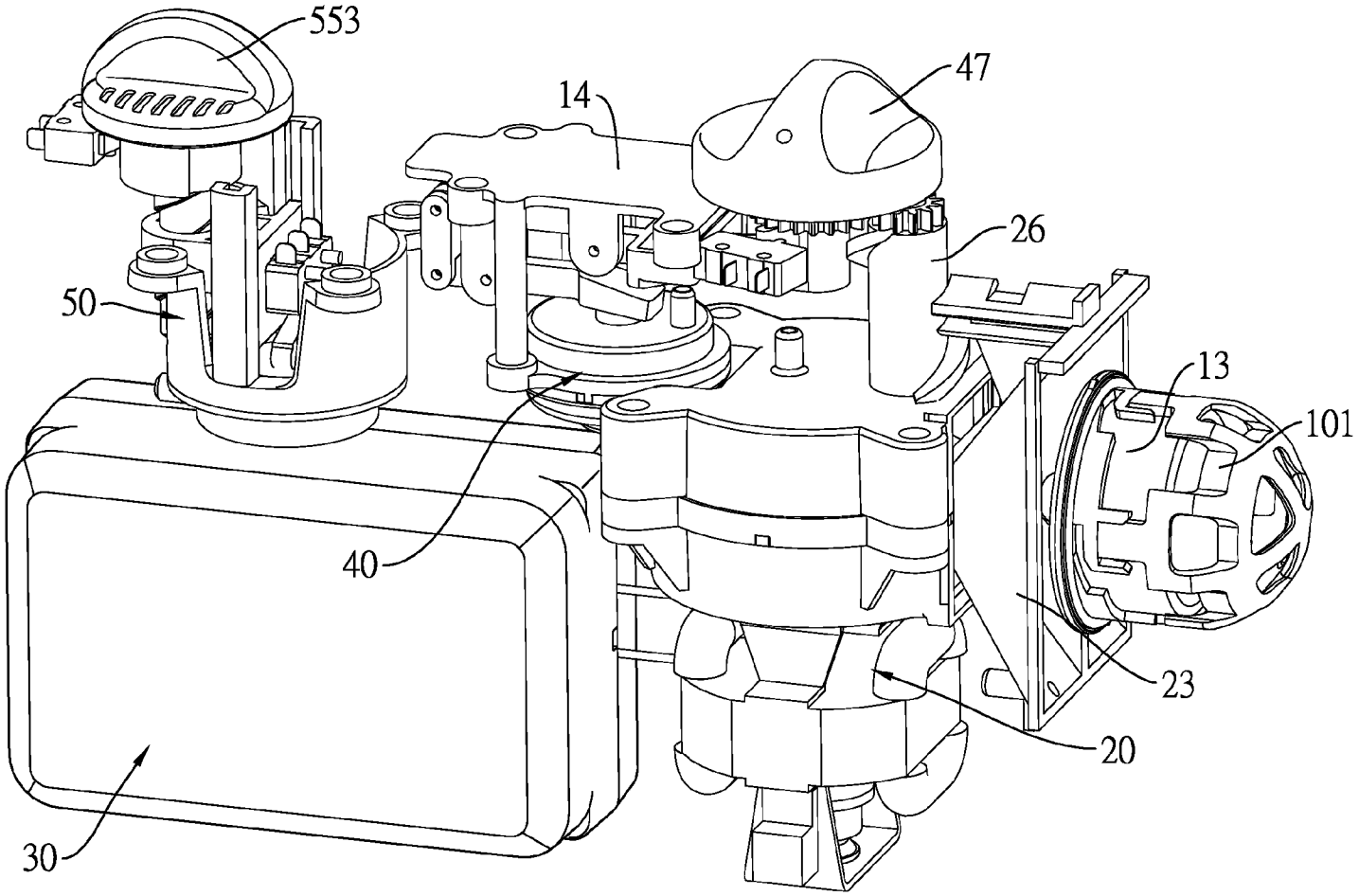
FIG. 5 is a perspective view of the air pump in FIG. 1, shown with a housing omitted.
Figure 6:
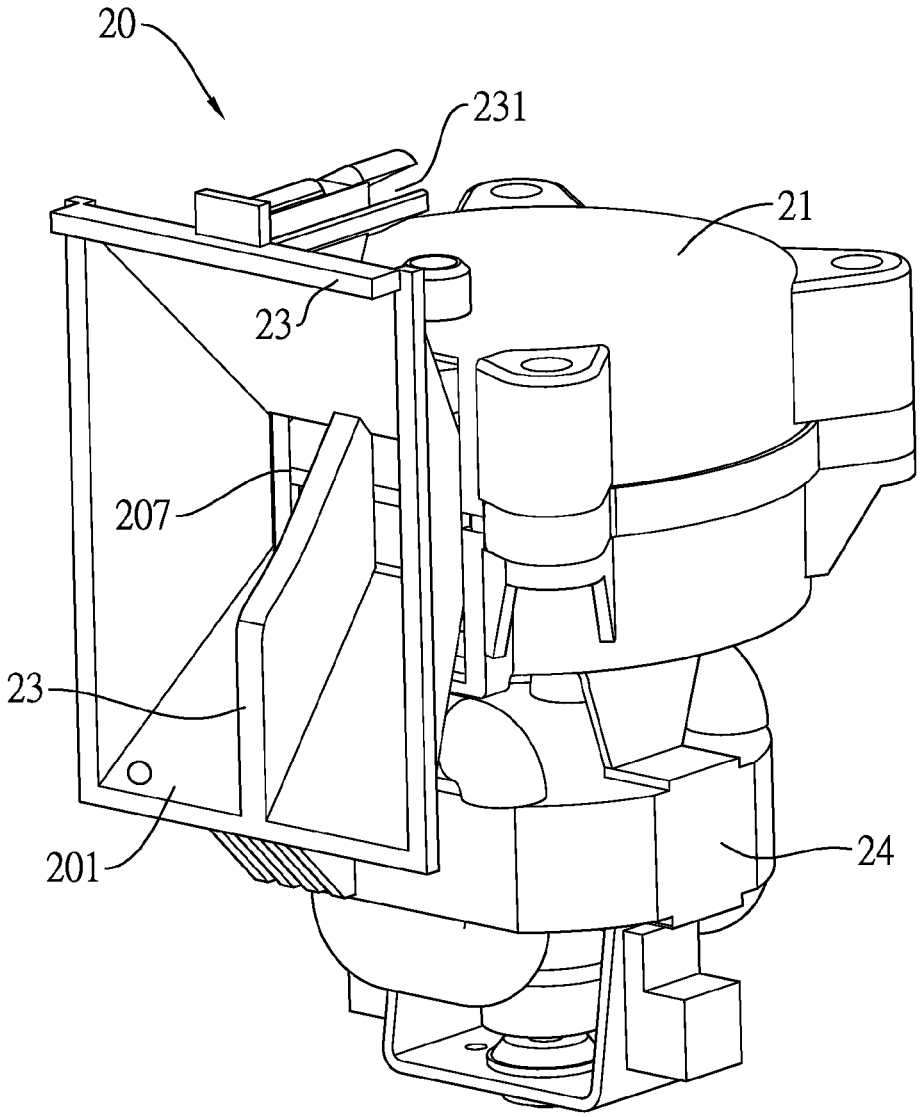
FIG. 6 is a perspective view of a low-pressure blower of the air pump in FIG. 1.

With reference to FIGS. 5 and 6, the low-pressure blower 20 is mounted in the mounting chamber of the housing 10 and has a fourth air port 201. The fourth air port 201 communicates with the first air port 101 of the housing 10.

Figure 4:
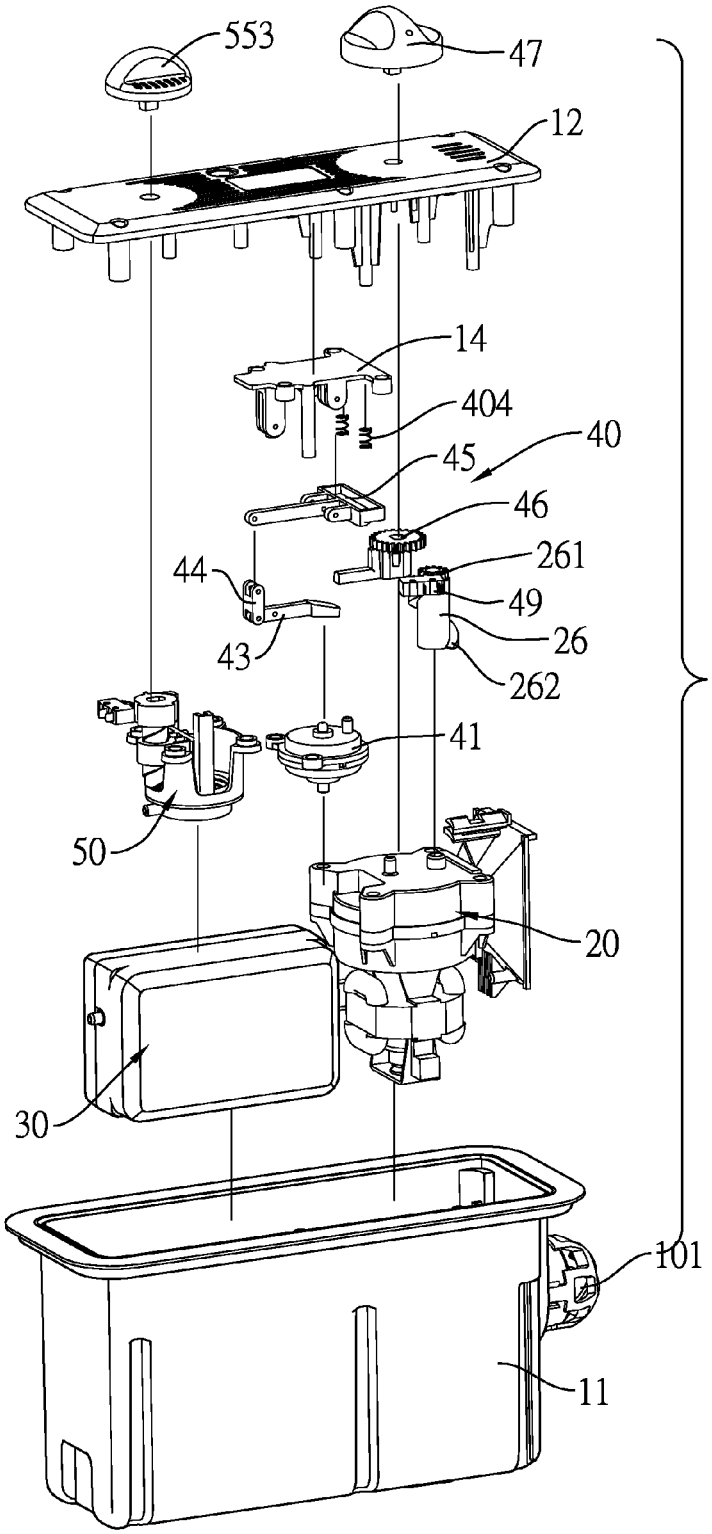
FIG. 4 is another exploded perspective view of the air pump in FIG. 1.
Figure 10:
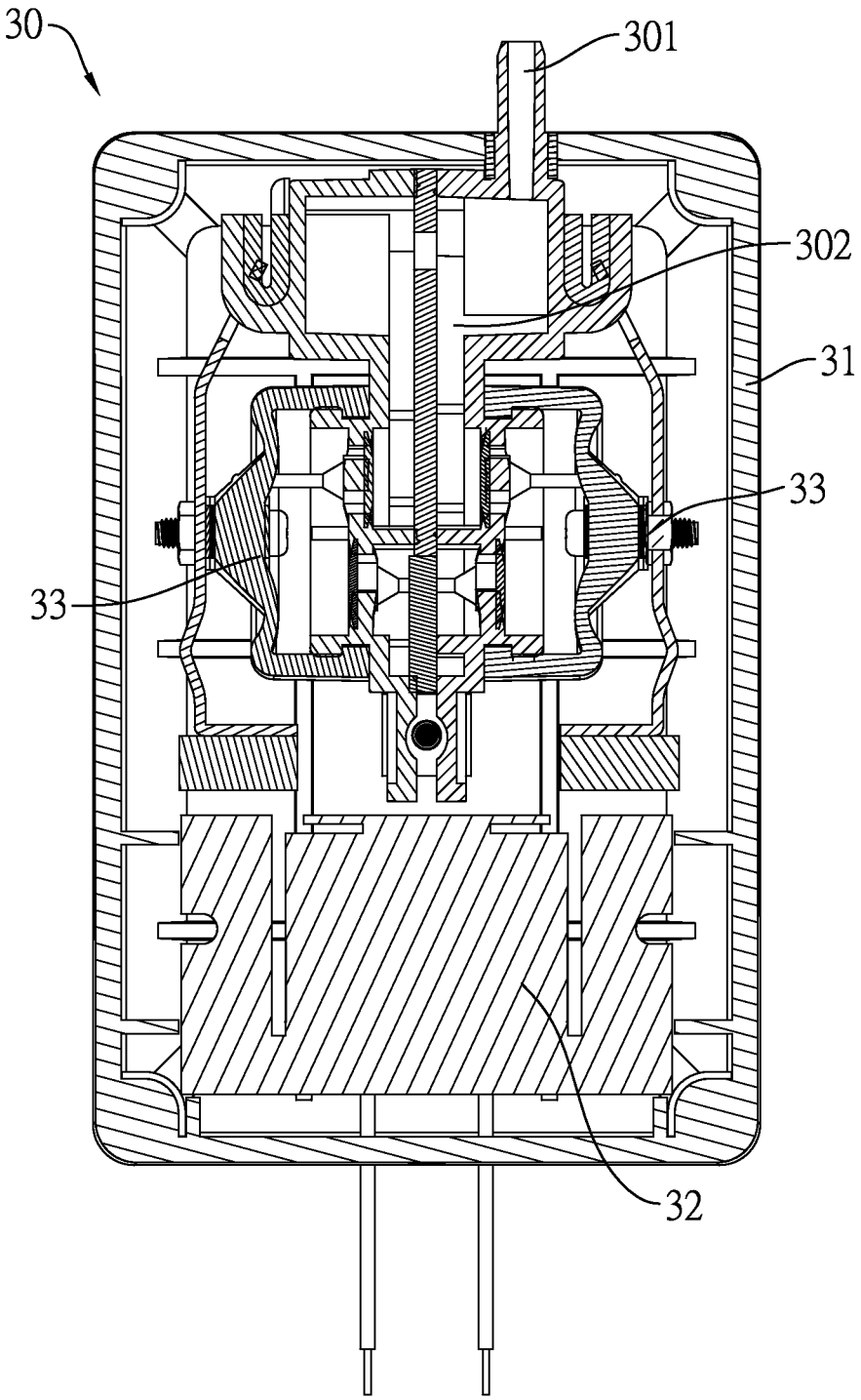
FIG. 10 is a side view in partial section of a high-pressure blower of the air pump in FIG. 1.
Figure 11:
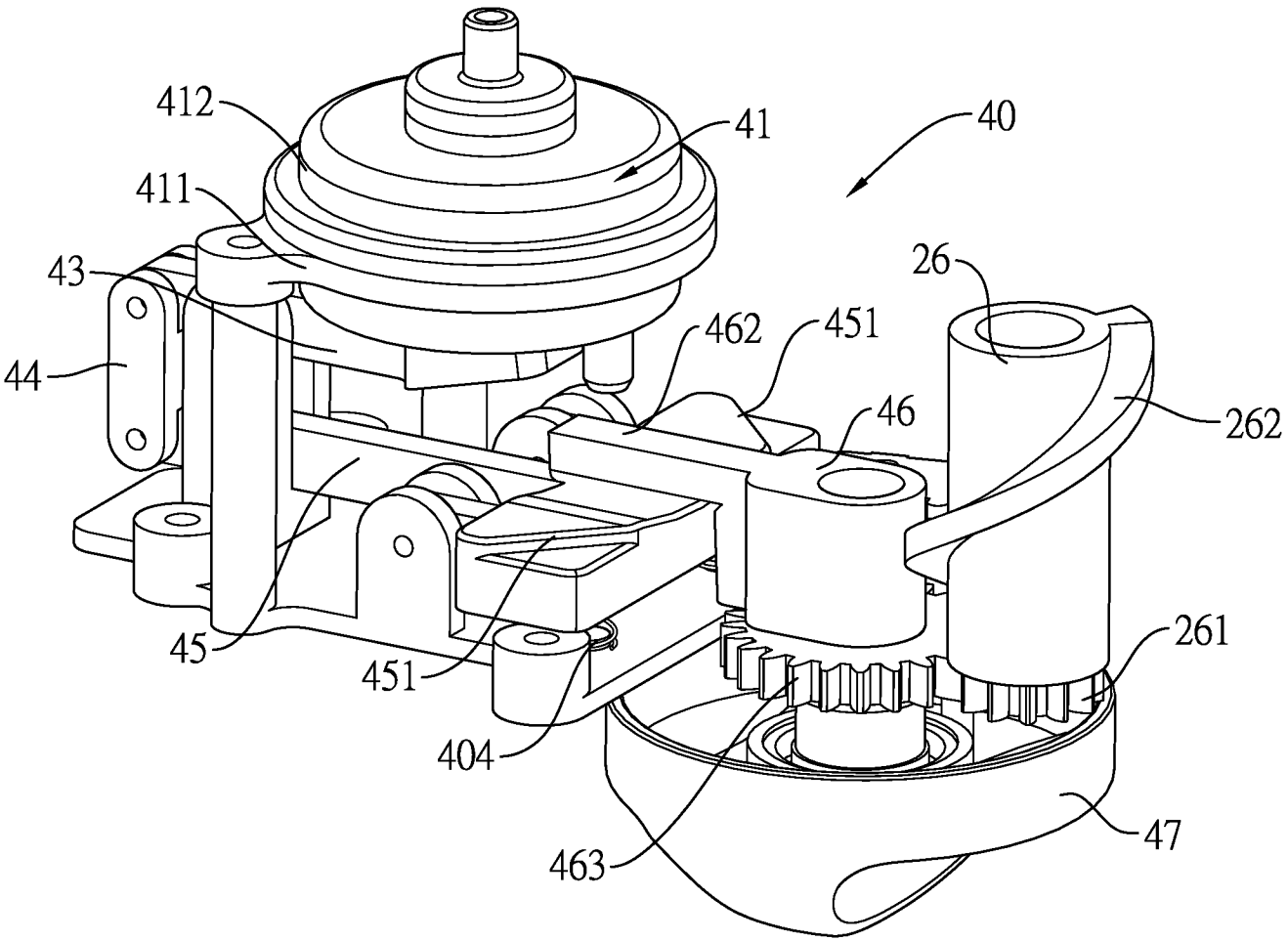
FIG. 11 is a perspective view of a first auto-stop controller of the air pump in FIG. 1, shown disposed upside down.
Figure 12:
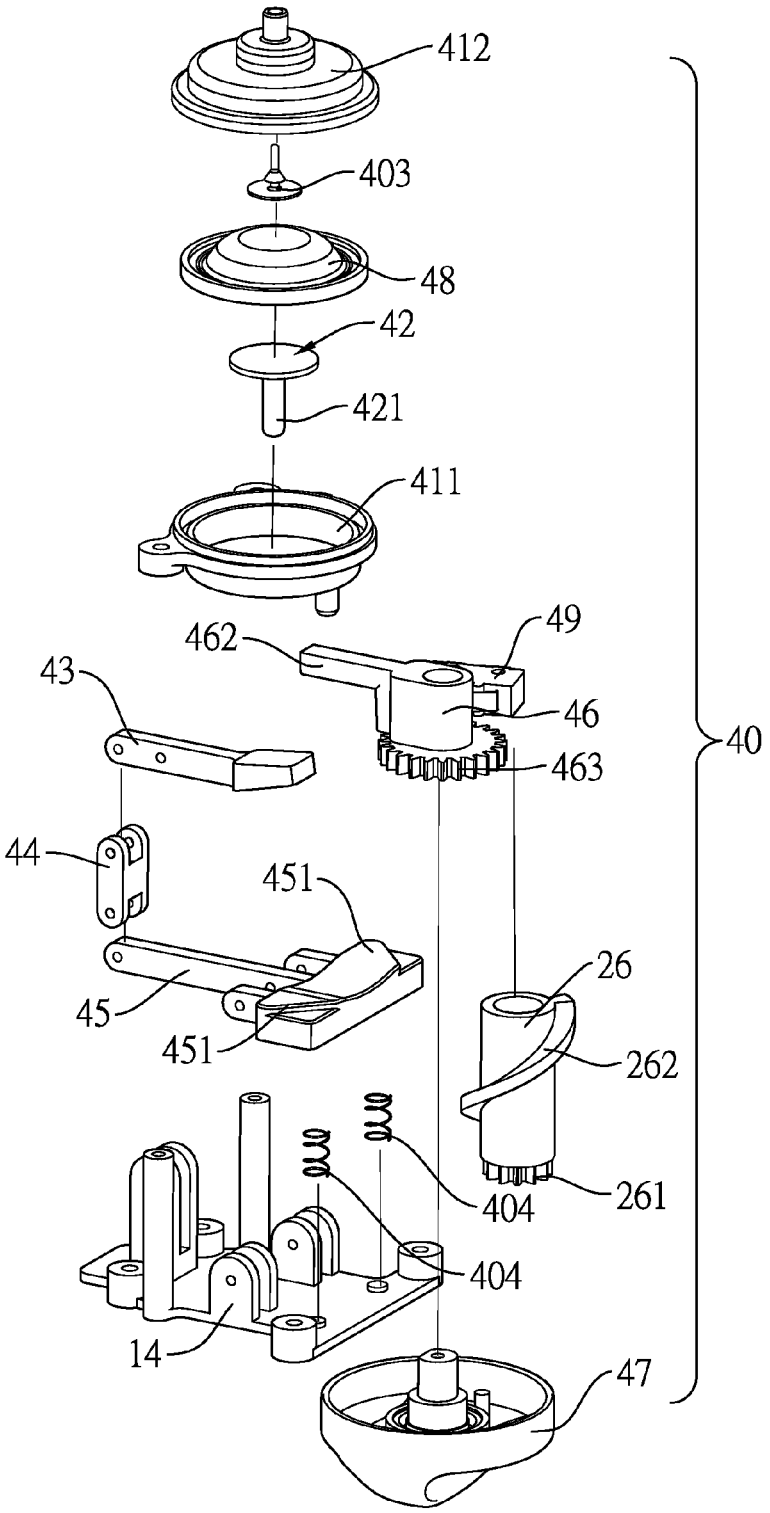
FIG. 12 is an exploded perspective view of the first auto-stop controller in FIG. 11, shown disposed upside down.
Figure 13:
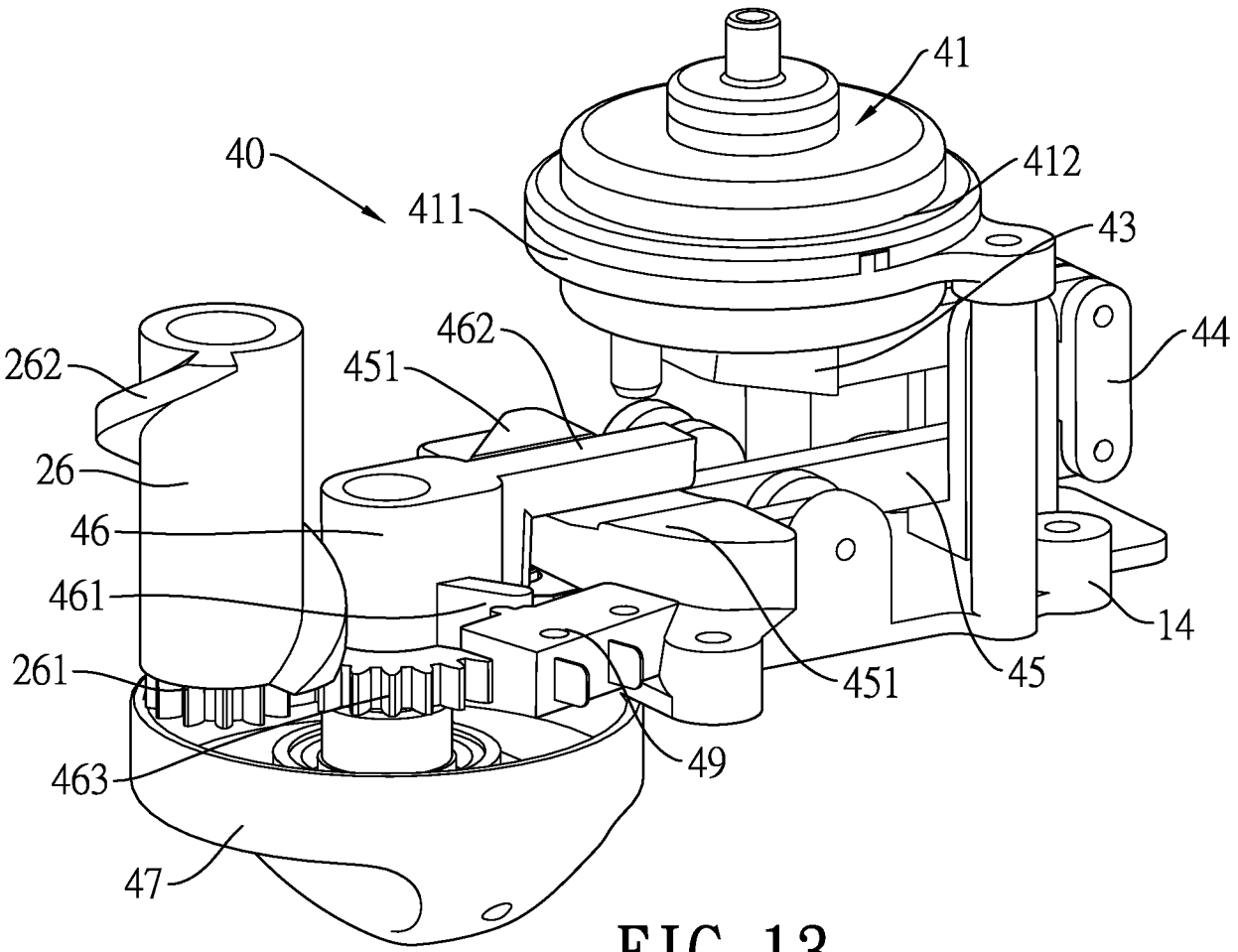
FIG. 13 is another perspective view of the first auto-stop controller in FIG. 11, shown disposed upside down.
Figure 14:
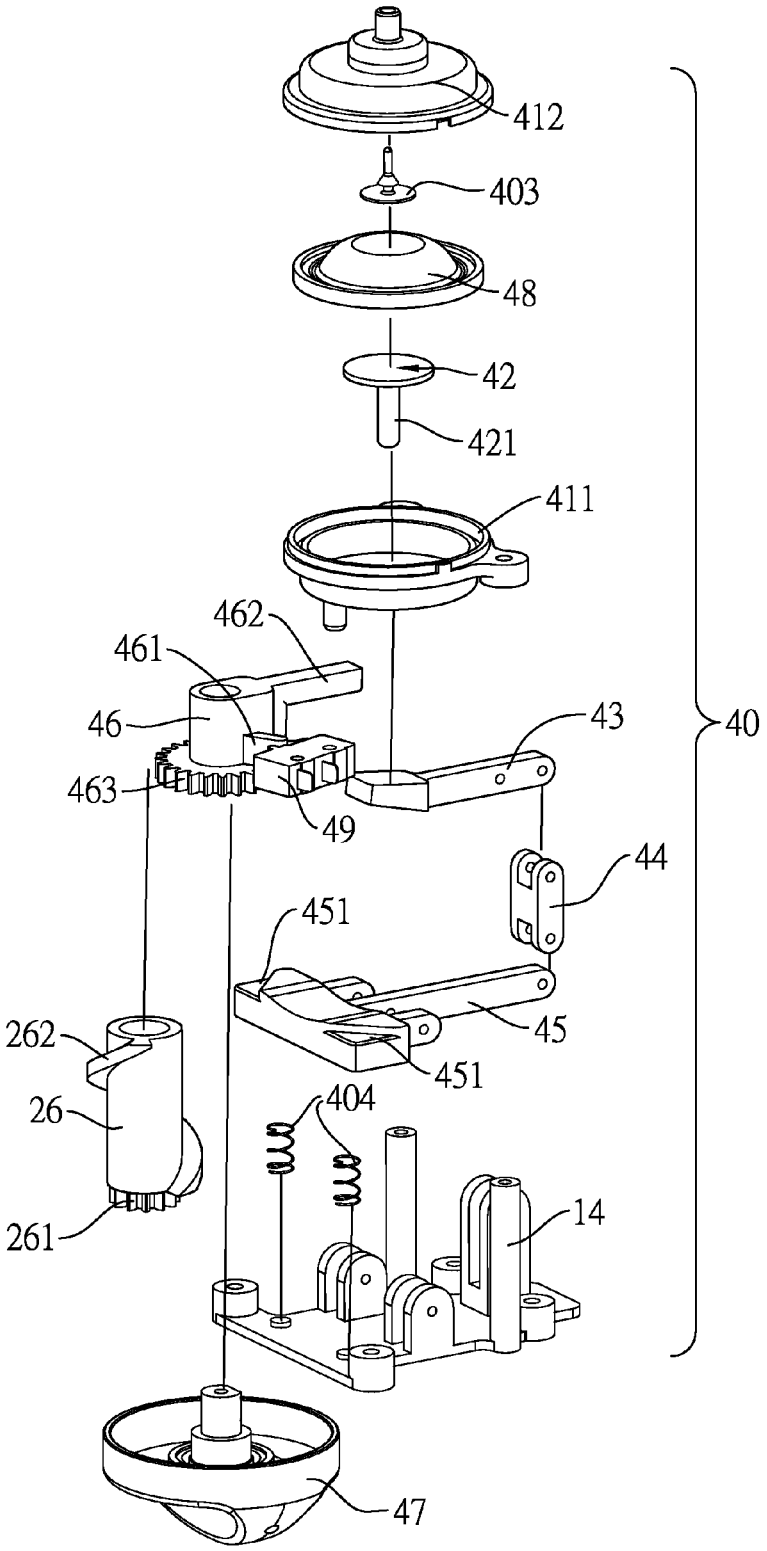
FIG. 14 is another exploded perspective view of the first auto-stop controller in FIG. 11, shown disposed upside down.

With reference to FIGS. 4 and 10, the high-pressure blower 30 is mounted in the mounting chamber of the housing 10 and has a fifth air port 301. The fifth air port 301 communicates with the second air port 102 of the housing 10.

With reference to FIGS. 3 to 5, and 11 to 15, the first auto-stop controller 40 is mounted in the mounting chamber of the housing 10 and has a first casing 41, a first air pressure sensing film 48, a one-way valve blade 403, a pushing element 42, a swing rod 43, a connecting rod 44, a rotation restricting element 45, at least one restoring spring 404, a first micro switch 49, a rotational pressing rod 46, and a first turning button 47.

The first casing 41 is formed by attaching a lid 412 onto a seat 411.

Figure 15:
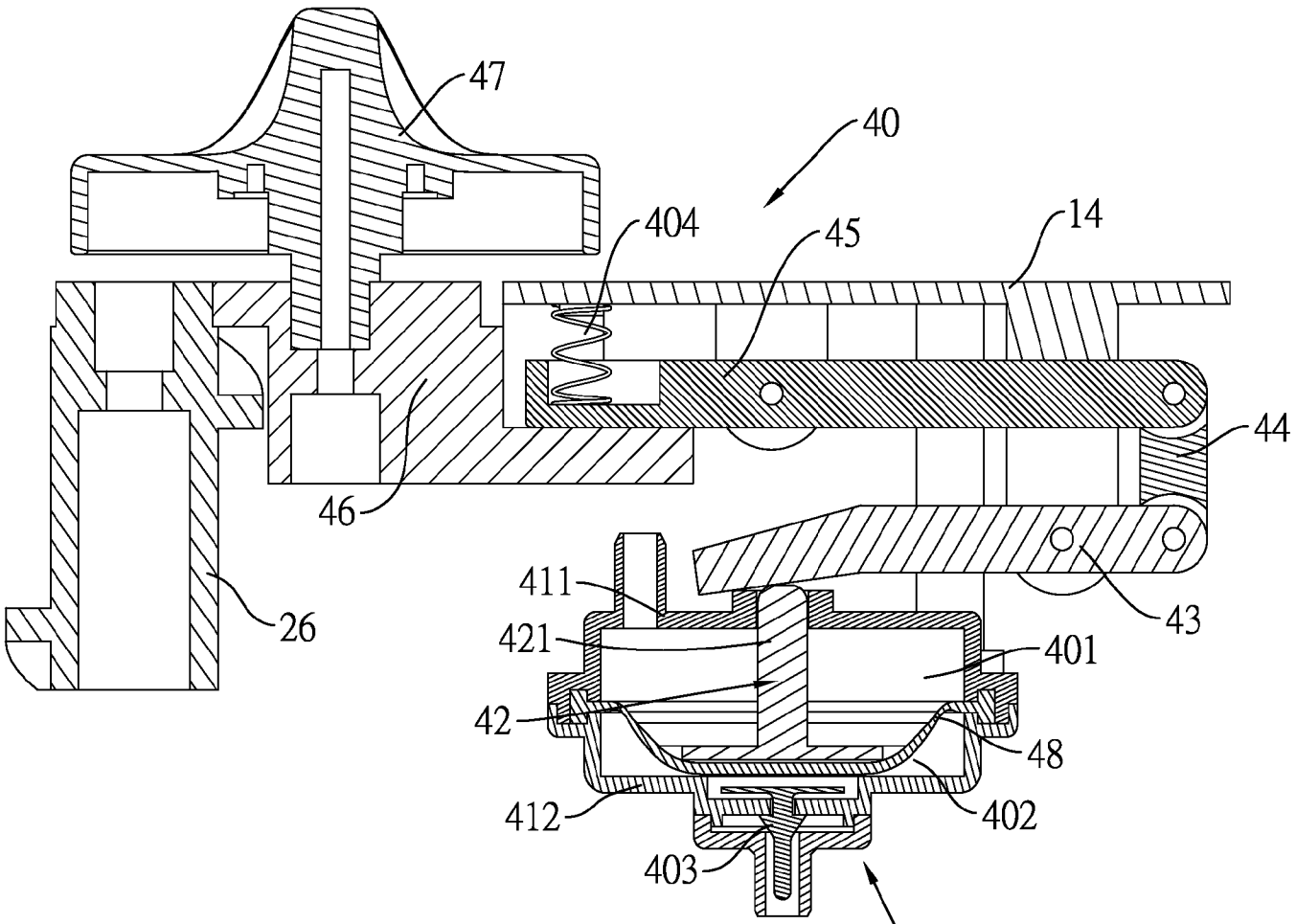
FIG. 15 is a side view in partial section of the first auto-stop controller in FIG. 11.
Figure 16:
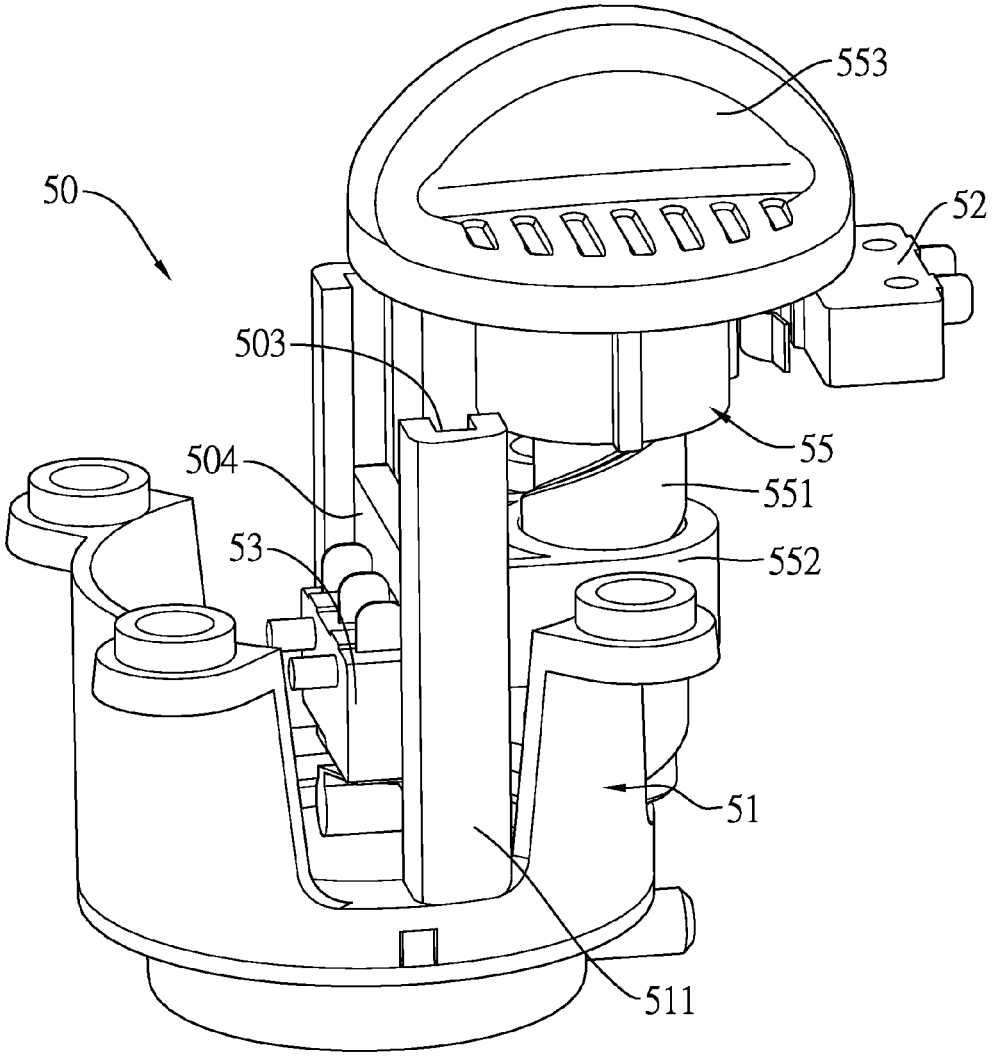
FIG. 16 is a perspective view of a second auto-stop controller of the air pump in FIG. 1.
Figure 17:
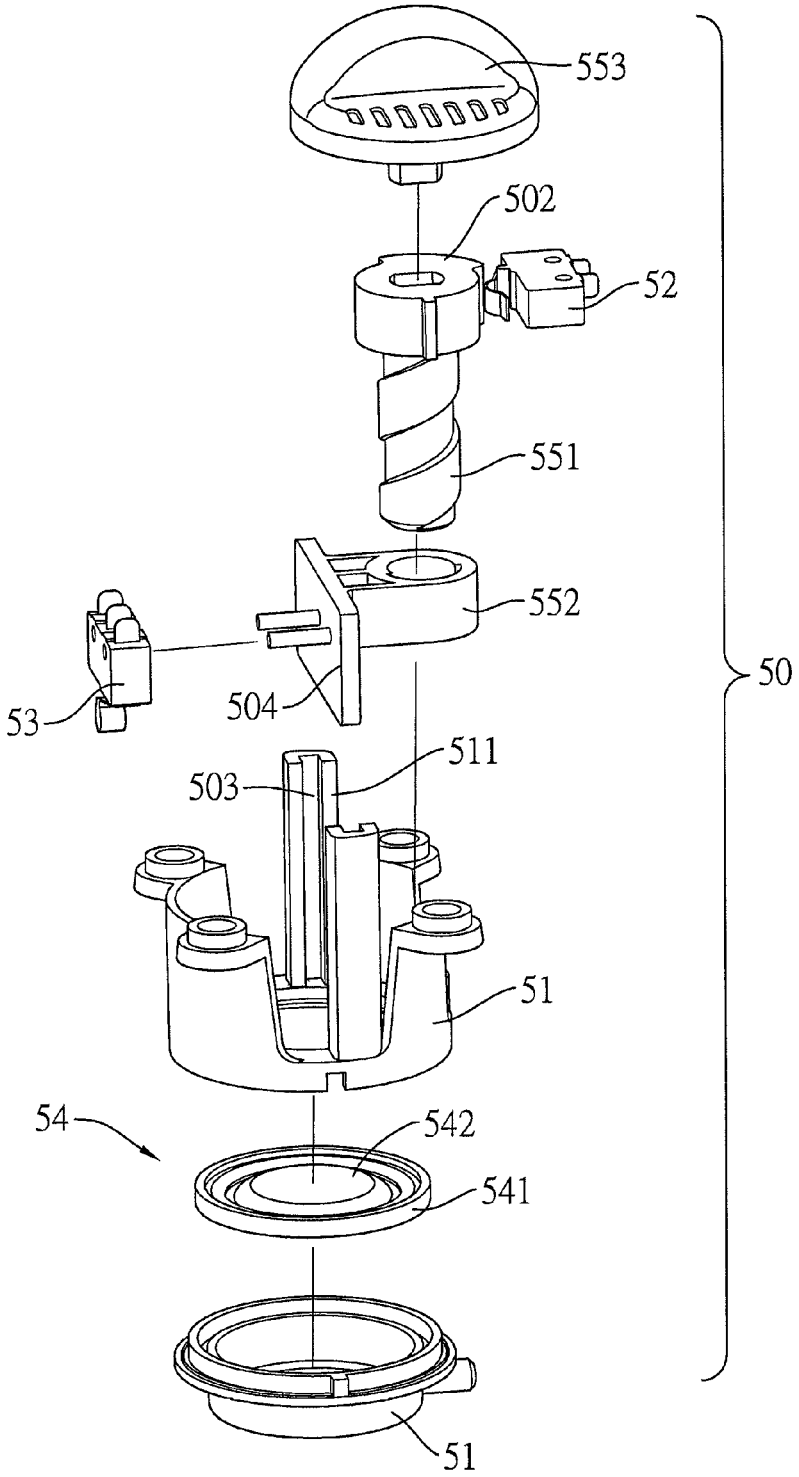
FIG. 17 is an exploded perspective view of the second auto-stop controller in FIG. 16.
Figure 18:
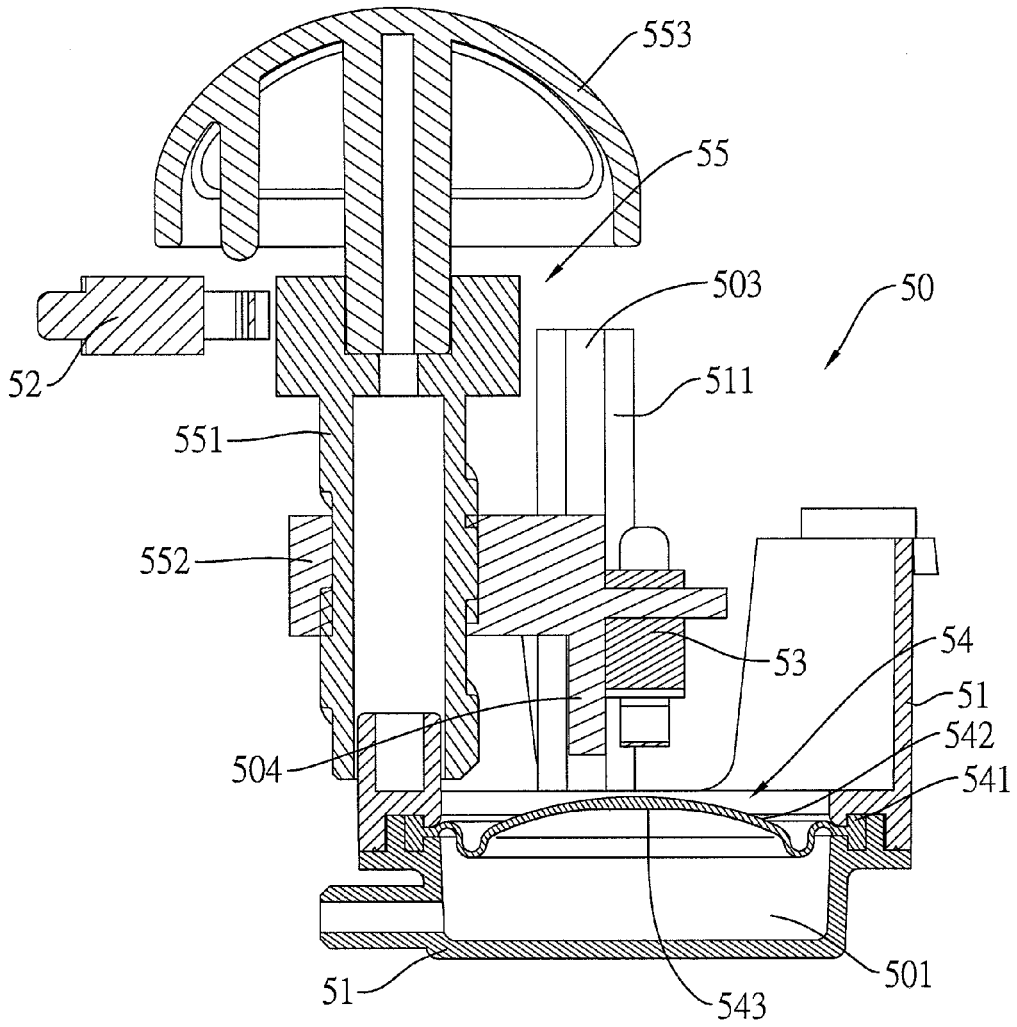
FIG. 18 is a side view in partial section of the second auto-stop controller in FIG. 16.

As shown in FIG. 15, the first air pressure sensing film 48 is securely mounted in the first casing 41 and divides an interior of the first casing 41 into a first chamber 401 and a second chamber 402. The first chamber 401 communicates with an exterior of the first casing 41. The second chamber 402 communicates with the third air port 103. The one-way valve blade 403 is mounted to an inlet of the second chamber 402. The pushing element 42 is mounted in the first chamber 401 and has a driven end 421 protruding out of the first casing 41.

The swing rod 43 is pivotally disposed outside the first casing 41 and has a first end and a second end. The first end of the swing rod 43 faces the driven end 421 of the pushing element 42. The connecting rod 44 has two ends. One of the ends of the connecting rod 44 is pivotally connected to the second end of the swing rod 43. The rotation restricting element 45 is pivotally disposed outside the first casing 41, and has a first end, a second end, and at least one limit portion 451. The first end of the rotation restricting element 45 is pivotally connected to the other end of the connecting rod 44. The at least one limit portion 451 is formed on the second end of the rotation restricting element 45. The at least one restoring spring 404 is mounted on the at least one limit portion 451 of the rotation restricting element 45.

The first micro switch 49 is disposed outside the first casing 41. The rotational pressing rod 46 is rotatably disposed outside the first casing 41 and has a pressing portion 461 and a positioning portion 462. The pressing portion 461 corresponds in position to and presses against the first micro switch 49. The positioning portion 462 operates in coordination with the at least one limit portion 451 of the rotation restricting element 45. The first turning button 47 is mounted on the housing 10 via a torsion spring and is disposed outside the housing 10. The first turning button 47 is connected to the rotational pressing rod 46 and selectively drives the rotational pressing rod 46 to rotate.

With reference to FIGS. 3 to 5 and 16 to 18, the second auto-stop controller 50 is mounted in the mounting chamber of the housing 10 and has a second casing 51, a switching switch 52, a second micro switch 53, a second air pressure sensing film 54, a third chamber 501, and an adjusting control mechanism 55.

The second casing 51 has an inner surface. The switching switch 52 is electrically connected to the high-pressure blower 30 and selectively switches the high-pressure blower 30 on or off. The second micro switch 53 is electrically connected to the high-pressure blower 30 and selectively switches the high-pressure blower 30 on or off. The second air pressure sensing film 54 is mounted in the second casing 51, selectively triggers the second micro switch 53, and has a peripheral edge 541, an outer surface 542, and an inner surface 543. The peripheral edge 541 of the second air pressure sensing film 54 is attached to the inner surface 543 of the second casing 51. The outer surface of 542 of the second air pressure sensing film 54 faces and is disposed apart from the second micro switch 53. The inner surface 543 of the second air pressure sensing film 54 is opposite to the outer surface 542 of the second air pressure sensing film 54. The third chamber 501 is surrounded by the inner surface 543 of the second air pressure sensing film 54 and the inner surface of the second casing 51, and communicates with the third air port 103 of the housing 10. The adjusting control mechanism 55 selectively triggers the switching switch 52, and drives the second micro switch 53 to move toward or away from the second air pressure sensing film 54.

Specifically, in the first preferred embodiment, the adjusting control mechanism 55 has a bolt 551, a nut 552, and a second turning button 553. The bolt 551 is rotatably mounted outside the second casing 51 and has a triggering protrusion 502. The triggering protrusion 502 selectively triggers the switching switch 52. The nut 552 is screwed on the bolt 551 and is rotatable to move along an axial direction of the bolt 551. The second micro switch 53 is securely mounted on the nut 552 and moves along with the nut 552. The second turning button 553 is disposed outside the housing 10, and is connected to and selectively drives the bolt 551 to rotate.

In the first preferred embodiment, the second casing 51 further has two guiding portions 511. Each of the guiding portions 511 has a guiding slot 503. The nut 552 has a positioning panel 504. The positioning panel 504 has two opposite side edges respectively engaging in the guiding slots 503 of the guiding portions 511, such that the positioning panel 504 can slide along the guiding slots 503. The second micro switch 53 is securely mounted on the positioning panel 504.

Figure 7:
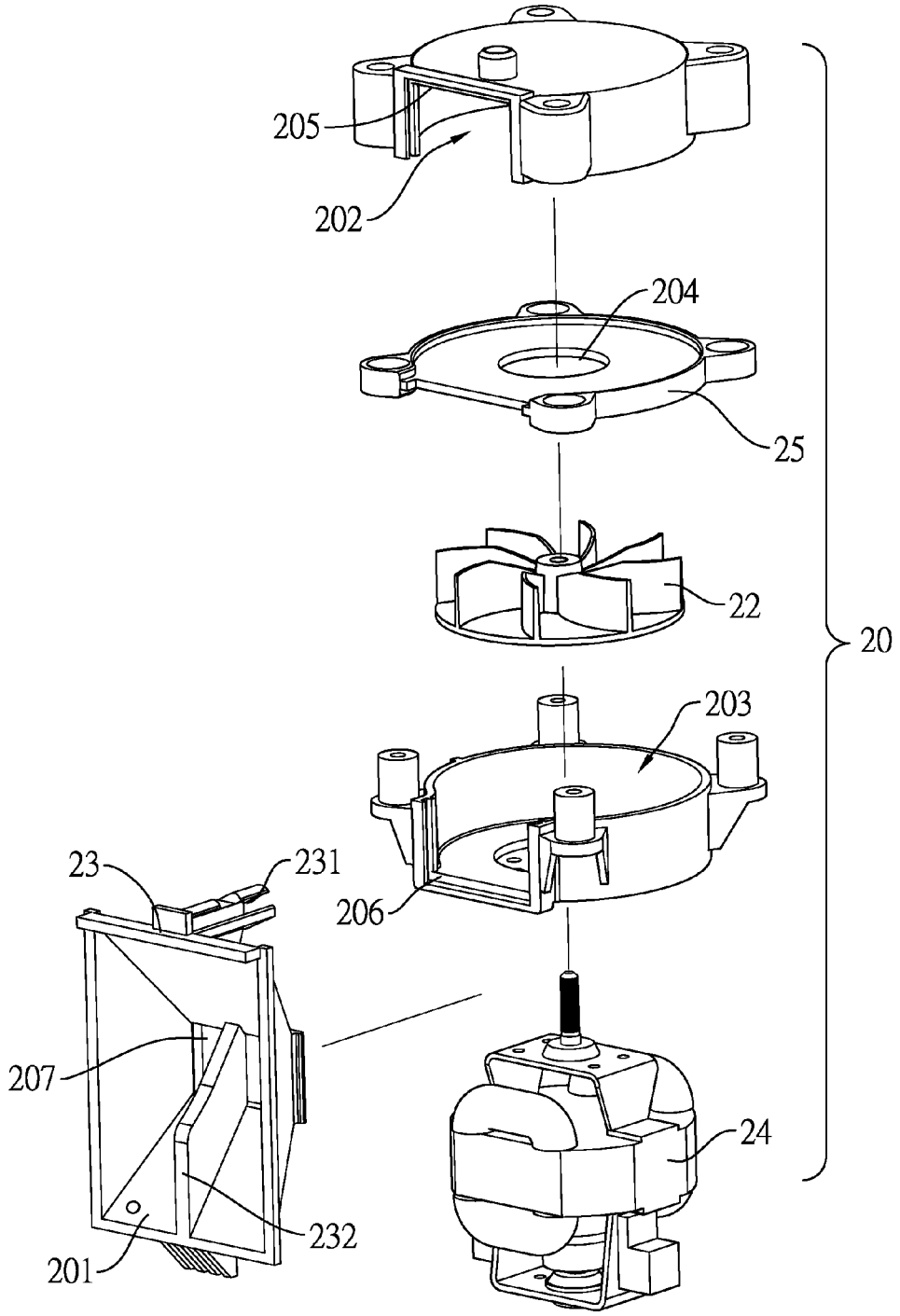
FIG. 7 is an exploded perspective view of the low-pressure blower in FIG. 6.

With reference to FIGS. 5 to 7, specifically, in the first preferred embodiment, the low-pressure blower 20 further has a third casing 21, a dividing panel 25, an impeller 22, a switching casing 23, a motor 24, and an air control mechanism 26.

The third casing 21 has an inlet port 205 and an outlet port 206. The dividing panel 25 is mounted in the third casing 21 and divides an interior of the third casing 21 into an inlet chamber 202 and an outlet chamber 203. The inlet chamber 202 communicates with the inlet port 205. The outlet chamber 203 communicates with the outlet port 206. The dividing panel 25 has a through hole 204. The impeller 22 is mounted in the outlet chamber 203 and has an air-inlet portion and an air-outlet portion. The air-inlet portion of the impeller 22 corresponds in position to the through hole 204 of the dividing panel 25. The air-outlet portion of the impeller 22 corresponds in position to the outlet port 206 of the third casing 21. The switching casing 23 is mounted between the first air port 101 of the housing 10 and the third casing 21 and has an air channel 207. The second chamber 402 of the first casing 41 communicates with the air channel 207. The air channel 207 selectively communicates with the inlet port 205 of the third casing 21 or the outlet port 206 of the third casing 21. The motor 24 drives the impeller 22 to rotate. The air control mechanism 26 drives the switching casing 23 to allow the air channel 207 of the switching casing 23 to selectively communicate with the inlet port 205 or the outlet port 206.

With reference to FIGS. 5 and 11 to 14, in the first preferred embodiment, the air control mechanism 26 is a screw and is rotatably mounted on the third casing 21. The air control mechanism 26 has a distal end, a peripheral surface, multiple first gear teeth 261, and a spiral rib 262. The first gear teeth 261 are arranged around the distal end of the air control mechanism 26. The rotational pressing rod 46 further has multiple second gear teeth 463 engaged with the first gear teeth 261 of the air control mechanism 26. The spiral rib 262 is formed on the peripheral surface of the air control mechanism 26. The switching casing 23 further has an engaging portion 231 engaged with the spiral rib 262 of the air control mechanism 26.

Moreover, the switching casing 23 further has a pressing protrusion 232 selectively opening the first one-way valve 13. When the pressing protrusion 232 of the switching casing 23 presses against the first one-way valve 13, the first one-way valve 13 is open and the air channel 207 communicates with the inlet port 205 of the third casing 21. When the pressing protrusion 232 of the switching casing 23 departs from the first one-way valve 13, the first one-way valve 13 is closed and the air channel 207 communicates with the outlet port 206 of the third casing 21.

Furthermore, specifically, the rotation restricting element 45 has two limit portions 451 separately formed on the second end of the rotation restricting element 45. The first auto-stop controller 40 has two restoring springs 404 respectively mounted on the two limit portions 451 of the rotation restricting element 45. A support bracket 14 is mounted in the housing 10. The first casing 41, the swing rod 43, and the rotation restricting element 45 are assembled on the support bracket 14. Two opposite ends of each of the restoring springs 404 respectively abut the support bracket 14 and the rotation restricting element 45.

With reference to FIG. 10, the high-pressure blower 30 further has a fourth casing 31, an electromagnetic assembly 32, and two open-close mechanisms 33. The electromagnetic assembly 32 and the open-close mechanisms 33 are mounted in the fourth casing 31. The open-close mechanisms 33 are connected to the electromagnetic assembly 32 and are driven to open or to close relative to each other by the electromagnetic assembly 32. When the open-close mechanisms 33 are open relative to each other, an air chamber 302 is formed between the open-close mechanisms 33 and communicates with the fifth air port 301 of the high-pressure blower 30.

The air pump with internal automatic controller works as follows.

For inflation, a position of the second micro switch 53 can be adjusted according to a demand for hardness of the inflatable article. Specifically, the second turning button 553 is turned to rotate the bolt 551 and to allow the nut 552 to move along the bolt 551 to a proper position. Accordingly, the second micro switch 53 moves along with the nut 552 to the proper position. As the distance defined between the second micro switch 53 and the second air pressure sensing film 54 is longer, the inflatable article is harder after inflating. As the distance defined between the second micro switch 53 and the second air pressure sensing film 54 is shorter, the inflatable article is softer after inflating. As the second turning button 553 is turned, the triggering protrusion 502 triggers the switching switch 52.

Then, the first turning button 47 is turned to sequentially drive the rotational pressing rod 46 and the air control mechanism 26 to rotate. As the air control mechanism 26 rotates, the switching casing 23 is driven to move downward to allow the air channel 207 of the switching casing 23 to communicate with the outlet port 206 of the third casing 21 and the fourth air port 201 of the low-pressure blower 20. Thus, the inlet port 205 of the third casing 21 communicates with the exterior of the housing 10.

Meanwhile, the pressing portion 461 of the rotational pressing rod 46 presses against the first micro switch 49, and the positioning portion 462 of the rotational pressing rod 46 is held in position by one of the limit portions 451 of the rotation restricting element 45. Accordingly, the low-pressure blower 20 begins working. The motor 24 drives the impeller 22 to rotate, thereby forming an air current. The air current pushes and opens the first one-way valve 13 and inflates the inflatable article. When an air pressure inside the inflatable article increases, an air pressure inside the second chamber 402 of the first casing 41 increases accordingly, and the first air pressure sensing film 48 deforms upward. When the air pressure inside the inflatable article achieves a pre-set low pressure, the first air pressure sensing film 48 pushes the pushing element 42, such that the driven end 421 of the pushing element 42 pushes the swing rod 43 to pivot and the rotation restricting element 45 is driven to rotate via the connecting rod 44. Consequently, the limit portions 451 of the rotation restricting element 45 depart from the positioning portion 462 of the rotational pressing rod 46. The rotational pressing rod 46 is restored to its original position, the pressing portion 461 of the rotational pressing rod 46 departs from the first micro switch 49, and the low-pressure blower 20 stops working.

Meanwhile, as the switching switch 52 is triggered and is switched on, the high-pressure blower 30 begins working. The electromagnetic assembly 32 drives the open-close mechanisms 33 to open or to close relative to each other and to compress air into the inflatable article. Thus, the air pressure inside the inflatable article increases continuously, an air pressure inside the third chamber 501 of the second casing 51 increases accordingly, and the second air pressure sensing film 54 deforms upward. When the air pressure inside the inflatable article achieves a pre-set high pressure, the second micro switch 53 is triggered by the second air pressure sensing film 54, and the high-pressure blower 30 stops working.

As the inflatable article is deflated slightly, the second air pressure sensing film 54 departs from the second micro switch 53, the high-pressure blower 30 is switched on automatically to inflate the inflatable article with high pressure air.

When the air pressure inside the inflatable article achieves the pre-set high pressure again, the second micro switch 53 is triggered by the second air pressure sensing film 54, such that the high-pressure blower 30 stops working. Consequently, the air pressure inside the inflatable article is kept at the pre-set high pressure.

As for deflation, the second turning button 553 is turned to rotate the bolt 551 and to allow the triggering protrusion 502 of the bolt 551 to depart from the switching switch 52. Then the first turning button 47 is turned reversely to sequentially drive the rotational pressing rod 46 and the air control mechanism 26 to rotate. As the air control mechanism 26 rotates, the switching casing 23 is driven to move upward to allow the air channel 207 of the switching casing 23 to communicate with the inlet port 205 of the third casing 21 and the fourth air port 201 of the low-pressure blower 20. Thus, the outlet port 206 of the third casing 21 communicates with the exterior of the housing 10.

Meanwhile, the pressing protrusion 232 of the switching casing 23 presses against the driving rod 131 of the first one-way valve 13 to open the first one-way valve 13. Thus, air inside the inflatable article discharges through the first air port 101 of the housing 10, the fourth air port 201 of the low-pressure blower 20, the air channel 207 of the switching casing 23, the inlet port 205 of the third casing 21, the inlet chamber 202 of the third casing 21, the outlet chamber 203 of the third casing 21, and the outlet port 206 of the third casing 21 in sequence.

Meanwhile, the pressing portion 461 of the rotational pressing rod 46 presses against the first micro switch 49, and the positioning portion 462 of the rotational pressing rod 46 is held in position by the other one of the limit portions 451 of the rotation restricting element 45. Accordingly, the low-pressure blower 20 begins working. The motor 24 drives the impeller 22 to rotate to accelerate a speed of discharging the air inside the inflatable article. With the air pressure inside the inflatable article decreases, the one-way valve blade 403 seals the inlet of the second chamber 402, such that the air pressure inside the second chamber 402 remains steady. Meanwhile, the air pressure inside the first chamber 401 decreases accordingly, and the first air pressure sensing film 48 deforms upward. When the air inside the inflatable article is discharged completely, the first air pressure sensing film 48 pushes the pushing element 42, such that the driven end 421 of the pushing element 42 pushes the swing rod 43 to pivot and the rotation restricting element 45 is driven to rotate via the connecting rod 44. Consequently, the limit portions 451 of the rotation restricting element 45 depart from the positioning portion 462 of the rotational pressing rod 46. The rotational pressing rod 46 is restored to its original position, the pressing portion 461 of the rotational pressing rod 46 departs from the first micro switch 49, and the low-pressure blower 20 stops working.

Figure 19:
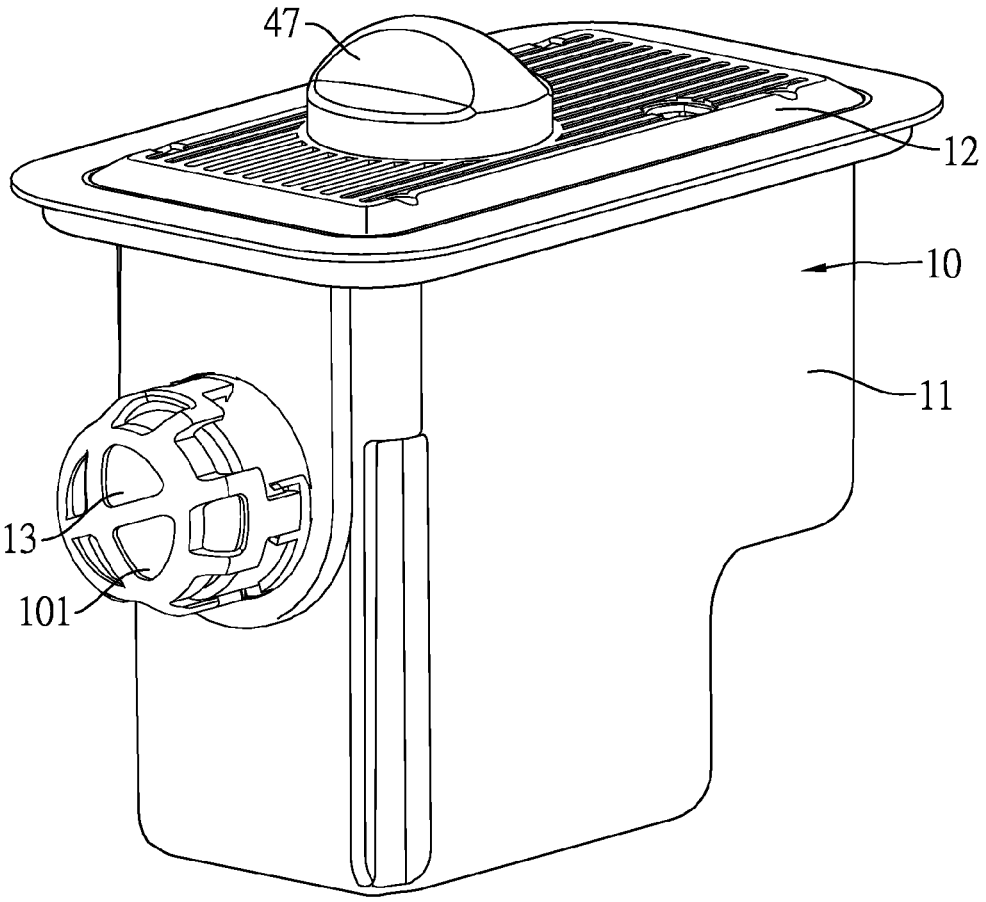
FIG. 19 is a front perspective view of a second embodiment of an air pump with internal automatic controller in accordance with the present invention.
Figure 20:
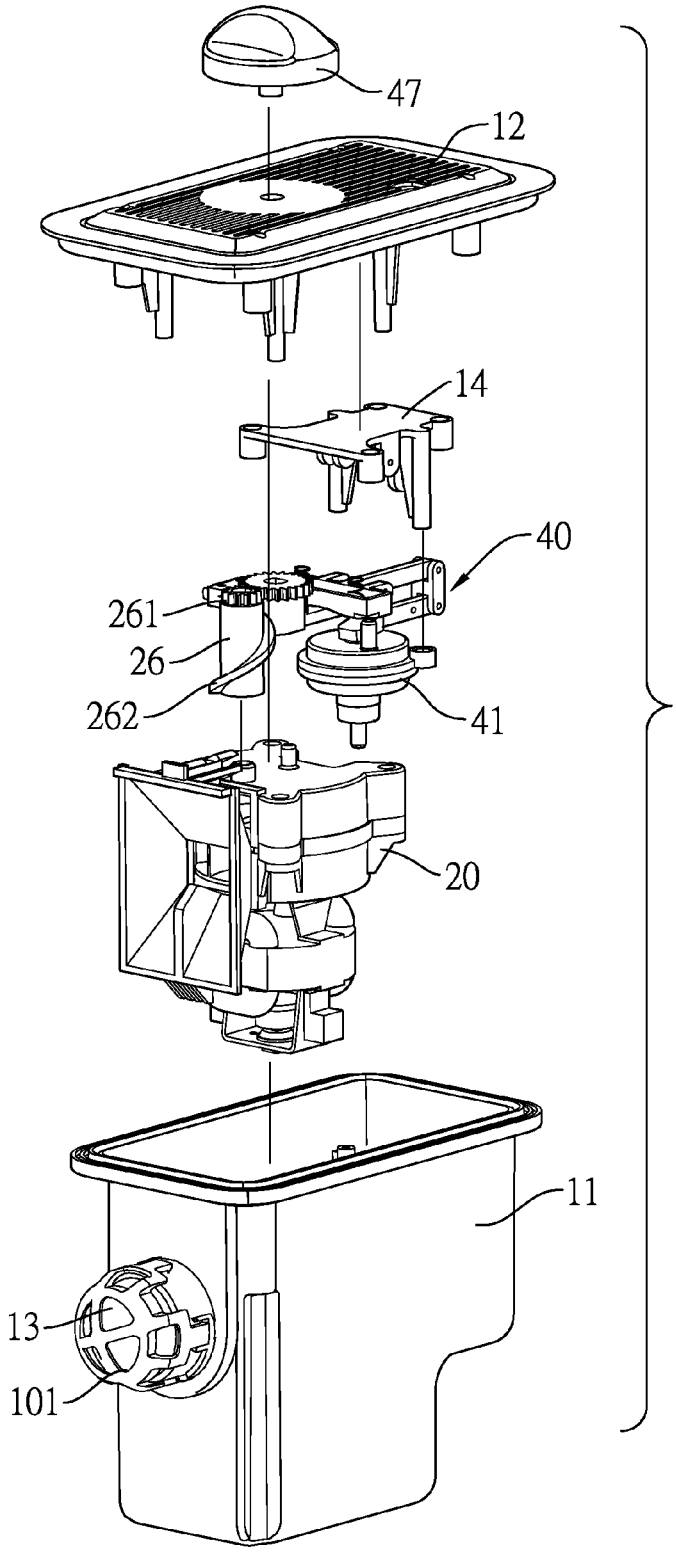
FIG. 20 is an exploded perspective view of the air pump in FIG. 19.

With reference to FIGS. 19 and 20, a second preferred embodiment of an air pump with internal automatic controller in accordance with the present invention is shown. Differences between the second preferred embodiment and the first preferred embodiment are as follows.

In the second preferred embodiment, the low-pressure blower 20 and the first auto-stop controller 40 are mounted in the housing 10. The high-pressure blower 30 and the second auto-stop controller 50 are omitted. Structures of the low-pressure blower 20 and the first auto-stop controller 40 of the second preferred embodiment are the same as structures of the low-pressure blower 20 and the first auto-stop controller 40 of the first preferred embodiment. Thus, descriptions about the low-pressure blower 20 and the first auto-stop controller 40 of the second preferred embodiment are omitted.

Working processes of the second preferred embodiment of the air pump are basically the same as working processes of the first preferred embodiment of the air pump.

The air pump as described has the main technical features as follows. With the low-pressure blower 20 inflating the inflatable article with low pressure air, and with the pushing element 42, the swing rod 43, the connecting rod 44, the rotation restricting element 45, the rotational pressing rod 46, the first turning button 47, the first air pressure sensing film 48, and the first micro switch 49 stably and reliably controlling the low-pressure blower 20, the low-pressure blower 20 stops working automatically. The first auto-stop controller 40 has simplified structure and inflates the inflatable article without manual work, which is a great convenience to users.

Moreover, with the high-pressure blower 30 inflating the inflatable article with high pressure air, and with the second micro switch 53 adjustably disposed above the second air pressure sensing film 54, the inflatable article can be inflated with the high pressure air in order to have hardness suitable for the user's need. As the air pressure inside the inflatable article achieves the pre-set high pressure, the second air pressure sensing film 54 presses against the second micro switch 53 to stop the high-pressure blower 30, such that the air pump can stop working when inflating with high pressure air automatically.

When the air pressure inside the inflatable article decreases, the second air pressure sensing film 54 departs from the second micro switch 53, such that the high-pressure blower 30 begins working automatically. The air pump can supply air when inflating with high pressure air automatically, and can inflate the inflatable article to the hardness suitable for the user's need.

Furthermore, by turning the second turning button 553 to rotate the bolt 551, the nut 552 can move along the bolt 551 back and forth, and the second micro switch 53 selectively departs from or approaches the second air pressure sensing film 54. Positions of the second micro switch 53 are adjusted steplessly, so that the inflatable article can be inflated to the hardness that is most suitable for the user's need. The second auto-stop controller 50 has simplified structure and can be operated conveniently and rapidly, which is a great convenience to the users.

With the switching casing 23 driven by the air control mechanism 26, the air channel 207 of the switching casing 23 selectively communicates with the inlet port 205 or the outlet port 206 of the third casing 21. When the air channel 207 communicates with the inlet port 205, the first one-way valve 13 is open so as to inflate the inflatable article. Thus, the air pump not only can inflate the inflatable article, but also can deflate the inflatable article rapidly. The air pump as described has simplified structure, is convenient for assembling, and can achieve high manufacturing efficiency and low manufacturing cost.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An air pump with an internal automatic controller comprising:

a housing having a first air port;

a second air port;

a third air port;

a first one-way valve mounted to the first air port; and a second one-way valve mounted to the second air port;

a low-pressure blower mounted in the housing and having a fourth air port communicating with the first air port;

a high-pressure blower mounted in the housing and having a fifth air port communicating with the second air port of the housing;

a first auto-stop controller mounted in the housing and having a first casing;

a first air pressure sensing film securely mounted in the first casing and dividing an interior of the first casing into a first chamber and a second chamber, the first chamber communicating with an exterior of the first casing, and the second chamber communicating with the third air port;

a pushing element mounted in the first chamber and having a driven end protruding out of the first casing;

a swing rod pivotally disposed outside the first casing and having a first end facing the driven end of the pushing element; and a second end;

a connecting rod having two ends, and one of the ends of the connecting rod pivotally connected to the second end of the swing rod;

a rotation restricting element pivotally disposed outside the first casing, and having a first end pivotally connected to the other end of the connecting rod;

a second end; and at least one limit portion formed on the second end of the rotation restricting element;

at least one restoring spring mounted on the at least one limit portion of the rotation restricting element;

a first micro switch disposed outside the first casing; the first micro switch electrically connected to the low-pressure blower and selectively switching the low-pressure blower on or off;

rotational pressing rod rotatably disposed outside the first casing and having a pressing portion corresponding in position to and pressing against the first micro switch; and a positioning portion operating in coordination with the at least one limit portion, and the limit portion restricting rotation of the rotational pressing rod; and a first turning button mounted on the housing via a torsion spring and disposed outside the housing, and the first turning button selectively driving the rotational pressing rod to rotate causing the pressing portion to operate the first micro switch; and a second auto-stop controller mounted in the housing and having a second casing having an inner surface;

a switching switch electrically connected to the high-pressure blower and selectively switching the high-pressure blower on or off;

a second micro switch electrically connected to the high-pressure blower and selectively switching the high-pressure blower on or off;

a second air pressure sensing film mounted in the second casing, selectively triggering the second micro switch, and having a peripheral edge attached to the inner surface of the second casing;

an outer surface facing and disposed apart from the second micro switch; and an inner surface being opposite to the outer surface of the second air pressure sensing film;

a third chamber surrounded by the inner surface of the second air pressure sensing film and the inner surface of the second casing, and communicating with the third air port; and an adjusting control mechanism selectively triggering the switching switch, and driving the second micro switch to move toward or away from the second air pressure sensing film, and the adjusting control mechanism having a bolt rotatably mounted outside the second casing and having a triggering protrusion, and the triggering protrusion selectively triggering the switching switch;

a nut screwed on the bolt and being rotatable to move along an axial direction of the bolt; and a second turning button disposed outside the housing, and connected to and selectively driving the bolt to rotate;

wherein the second micro switch is securely mounted on the nut and moves along with the nut.

2. The air pump as claimed in claim 1, wherein the low-pressure blower further has a third casing having an inlet port and an outlet port;

a dividing panel mounted in the third casing and dividing an interior of the third casing into an inlet chamber and an outlet chamber, the inlet chamber communicating with the inlet port, the outlet chamber communicating with the outlet port, and the dividing panel having a through hole;

an impeller mounted in the outlet chamber and having an air-inlet portion corresponding in position to the through hole; and an air-outlet portion corresponding in position to the outlet port;

a switching casing mounted between the first air port and the third casing and having an air channel selectively communicating with the inlet port or the outlet port;

a motor driving the impeller to rotate; and an air control mechanism driving the selective communication of the switching casing;

wherein the second chamber of the first casing communicates with the air channel of the switching casing.

3. The air pump as claimed in claim 2, wherein the switching casing further has a pressing protrusion selectively opening the first one-way valve;

when the pressing protrusion of the switching casing presses against the first one-way valve, the first one-way valve is open and the air channel communicates with the inlet port; and when the pressing protrusion of the switching casing departs from the first one-way valve, the first one-way valve is closed and the air channel communicates with the outlet port.

4. The air pump as claimed in claim 2, wherein the air control mechanism is a screw and is rotatably mounted on the third casing, and the air control mechanism has a distal end;

a peripheral surface;

multiple first gear teeth arranged around the distal end of the air control mechanism; and a spiral rib fanned on the peripheral surface of the air control mechanism;

the rotational pressing rod further has multiple second gear teeth engaged with the first gear teeth of the air control mechanism; and the switching casing further has an engaging portion engaged with the spiral rib of the air control mechanism.

5. The air pump as claimed in claim 4, wherein a support bracket is mounted in the housing;

the first casing, the swing rod, and the rotation restricting element are assembled on the support bracket; and two opposite ends of each of the at least one restoring spring respectively abut the support bracket and the rotation restricting element.

6. The air pump as claimed in claim 1, wherein a one-way valve blade is mounted to an inlet of the second chamber.

7. The air pump as claimed in claim 1, wherein the high-pressure blower further has a fourth casing;

an electromagnetic assembly mounted in the fourth casing; and two open-close mechanisms mounted in the fourth casing, the open-close mechanisms connected to the electromagnetic assembly and driven to open or to close relative to each other by the electromagnetic assembly;

wherein when the open-close mechanisms are open relative to each other, an air chamber is formed between the open-close mechanisms and communicates with the fifth air port.

8. The air pump as claimed in claim 1, wherein the second casing further has two guiding portions, and each of the guiding portions has a guiding slot;

the nut has a positioning panel, and the positioning panel has two opposite side edges respectively engaging in the guiding slots of the guiding portions to slide along the guiding slots; and the second micro switch is securely mounted on the positioning panel.

* * * * *